United States Patent [19]

Meldrum

[11] 4,123,912

[45] Nov. 7, 1978

[54] LIGHTWEIGHT DEMOUNTABLE DOCK ASSEMBLY

[76] Inventor: Charles R. Meldrum, 18887 Bretton, Detroit, Mich. 48223

[21] Appl. No.: 791,966

[22] Filed: Apr. 28, 1977

[51] Int. Cl.[2] ..... E02B 3/20

[52] U.S. Cl. ..... 405/220; 14/10; 14/71.1

[58] Field of Search ..... 61/48, 94; 14/9, 10, 14/69.5, 71.1; 114/263

[56] References Cited

U.S. PATENT DOCUMENTS

| | | | |
|---|---|---|---|
| 1,122,504 | 12/1914 | Huebner | 14/9 |
| 1,273,231 | 7/1918 | Johansen | 61/48 X |
| 2,612,024 | 9/1952 | Hunsucker | 61/94 |
| 2,948,121 | 8/1960 | Karst | 61/48 |
| 2,984,944 | 5/1961 | Sapp | 14/9 X |
| 3,046,748 | 7/1962 | Monroe | 61/48 |
| 3,094,848 | 6/1963 | Albrecht | 61/48 |
| 3,456,448 | 7/1969 | Luque | 61/48 X |

*Primary Examiner*—Mervin Stein

*Assistant Examiner*—David H. Corbin

*Attorney, Agent, or Firm*—Alex Rhodes

[57] ABSTRACT

A dock assembly wherein single or interconnected composite beam mainspans are connected to a ramp extending from shore to the first neighboring mainspan and one end of each of said mainspans is supported by a tripod structure and the other end by vertical members. The composite beam mainspans comprise deck structures in combination with pre-tensioned cables, said cables being connected to the ends of the deck structures and extending obliquely along the underside of said deck structures in spaced relationship to the midpoint of said structures. Means attaching the principal members of said assembly are provided whereby the dock assembly may be readily installed or disassembled, or optionally, after removal of the mainspans and ramp, the support structures may be rotated at their footings for underwater storage. Height of the mainspan is adjustable for mainspan leveling and adjusting mainspan height from the water surface.

14 Claims, 8 Drawing Figures

LIGHTWEIGHT DEMOUNTABLE DOCK ASSEMBLY

BACKGROUND OF THE INVENTION

Docks — generally used for mooring boats or providing access to water — are structural spans originating on land surfaces and extending over bodies of water. Loads acting on docks are conveniently divided into the categories of dead loads arising from the weights of the structures themselves and live loads imposed by agencies such as pedestrians, wind, ice and water.

Development of efficient structures for large docks has proceeded by those skiled in the art, however, such has not been so for small docks which to a great extent have been inefficient structures, lacking in appearance, difficult to install and subject to frequent maintenance. In some localities, high winds and ice floes require the removal of small docks during winter months to prevent their destruction.

The expanded popularity of waterfront homes and sports such as boating, swimming and fishing has accelerated the demand for small docks. Portable lightweight docks which can be readily assembled and disassembled would be attractive to waterfront homeowners, marinas, park services, summer camps and military groups.

Clearly, small docks having reasonable initial costs, efficient structures, attractive appearance, low maintenance and simplified assembly and disassembly would be of benefit. Provisions for deck height adjustment to accommodate water depth at installation and subsequent changes in water level would be of further benefit.

SUMMARY OF THE INVENTION

The present invention is directed towards a dock assembly wherein single or multiple composite beam mainspans are connected to a ramp extending from the land surface to the first neighboring mainspan, one end of each of said mainspans being supported by a tripod structure and the other end by vertical supports.

Each composite beam mainspan comprises a deck structure in combination with pre-tensioned cables, said cables extending in spaced relationship obliquely across the underside of said deck structure. Means are provided for adjusting deck height to differences in water level. Means connecting principal members of said construction simplify dock installation and allow dock disassembly for storage, maintenance and repair.

It is an object of the present invention to provide a construction which can be readily installed and disassembled.

It is another object to provide a construction wherein mainspan height is adjustable for leveling the deck surface and adjusting mainspan height to differences in water level.

It is yet another object to provide lightweight dock structures having a high resistance to dead and live loads.

It is a further object to provide docks which are attractive in appearance and reasonable in cost.

It is still a further object to provide docks wherein after mainspan and ramp structures have been removed, their support structures can be pivoted about their lower attachments to horizontal positions for underwater storage.

It is an additional object to provide a tripod support structure not requiring cement footings or driven pilings.

Further features and benefits of the present invention will be apparent from the following description with reference to the accompanying drawings.

DETAILED DESCRIPTION OF THE INVENTION

Figure 1:
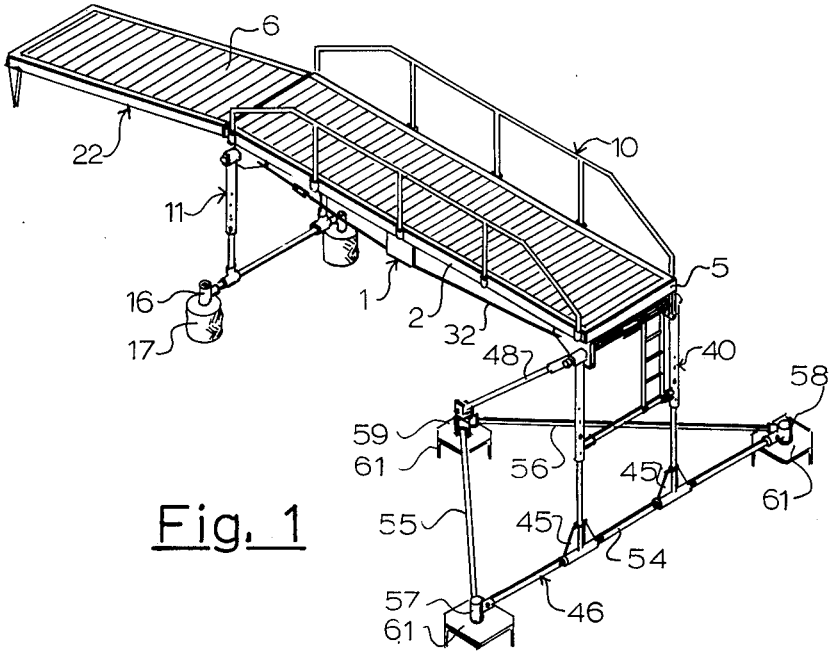
FIG. 1 is a perspective view of a preferred embodiment for a dock assembly according to the present invention, as viewed from above in a direction towards the land surface.

With reference to the accompanying drawings, a preferred embodiment of my invention, a dock assembly, is generally shown in FIG. 1 wherein said embodiment comprises a composite beam mainspan 1 in combination with a ramp 22 pivotally connected to one end of said mainspan 1 and a means supporting said mainspan 1 comprising a tripod structure 40 at one end of said mainspan and vertical support structure 11 at the other end. It is apparent that multiple composite beams can be interconnected to form mainspan 1.

Among the objects of my invention are reasonable cost and low weight. This has been accomplished by the construction of composite beam mainspan 1, ramp 22 and tubular support structures 40 and 11. Mainspan 1 comprises a framed deck structure 2 in combination with a pair of pre-tensioned cables 32, each of said cables being connected to opposite ends of deck structure 2 and extending obliquely along the underside of said structure 2 in spaced relationship to the mid-point of said structure 2.

Figures 4, 5, 8:
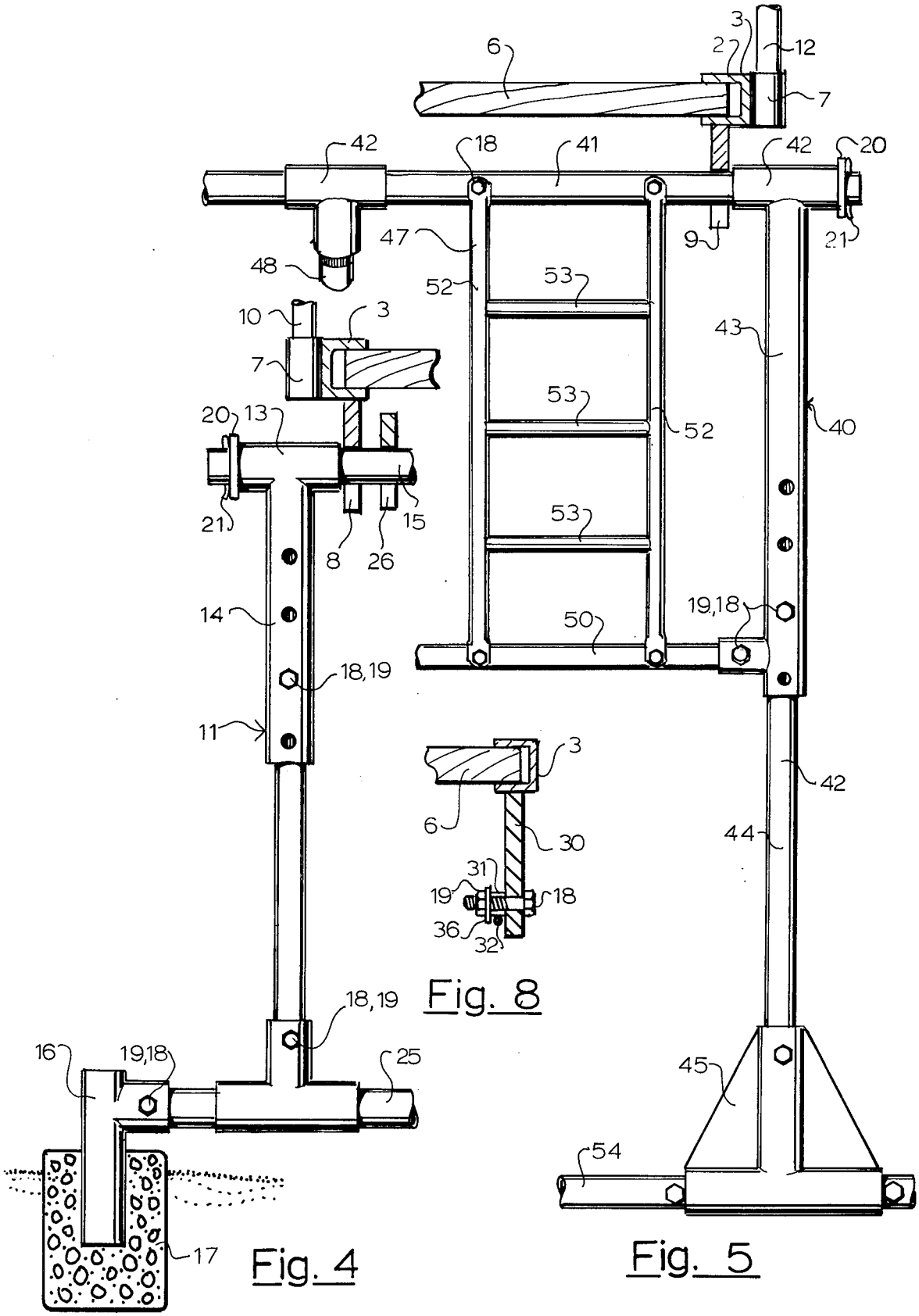
FIG. 4 is an enlarged partial cross-sectional view taken in the direction of arrows 4—4 in FIG. 3.
FIG. 5 is a partial view taken in the direction of arrows 5—5 in FIG. 3.
FIG. 8 is an enlarged partial cross-sectional view taken in the direction of arrows 8—8 in FIG. 3.
Figure 6:
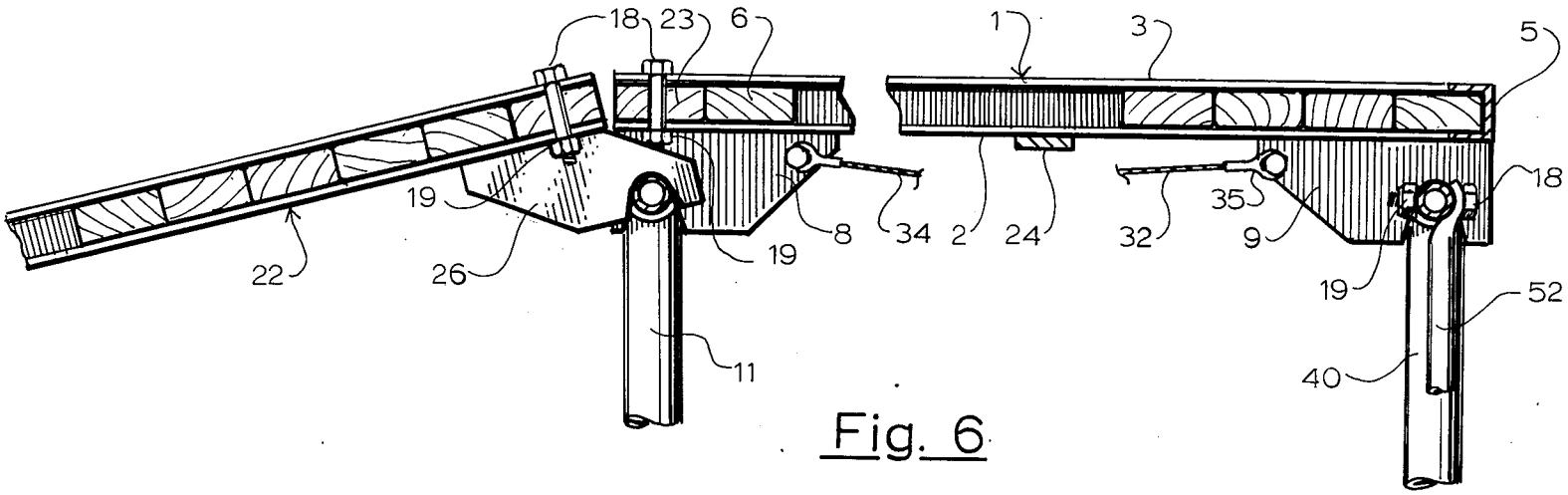
FIG. 6 is an enlarged partial cross-sectional view taken in the direction of arrows 6—6 in FIG. 5.

Deck structure 2 and ramp 22 are similarly constructed of open ended frames, the members of said frames being channeled configured for retaining a plurality of deck planks 6, said planks 6 providing deck surfaces for mainspan 1 and ramp 22. The construction of deck structure 2 is generally shown in FIGS. 5 and 6 comprising a pair of outer longitudinal members 3, an end lateral member 5 interconnecting the respective ends of said members 3, a plurality of spaced intermediate braces 24 interconnecting said members 3, a first pair of downward extending brackets 8 affixed to corresponding ends of outer members 3, a second pair of downward extending brackets 9 affixed to the other corresponding ends of members 3, a third pair of downward extending brackets 30 affixed to corresponding mid-points of members 3, a plurality of lateral deck planks 6 retained by said outer members 3 and end member 5, a pair of demountable guardrails 10 and sockets 7 attached to corresponding outer surfaces of said members 3, said sockets 7 retaining the guardrails 10. The lower end portions of guardrails 10 being slideably connected to sockets 7 co-act with said guardrails 10 to provide a system of friction dampers for decoupling mainspan 1 from oscillatory loads acting upon said mainspan 1.

The channel configuration of deck structure outer members 3 is shown in FIG. 5 wherein one of said members 3 is shown in cross-section comprising an outer vertical wall with inwardly extending upper and lower flanges. The open ended frame of deck structure 2 provides a convenient means for installing and removing deck planks 6 being retained in the channel configuration of said frame. It is apparent in FIG. 6 that planks 6 cannot be removed after ramp 22 has been installed. Optionally, end deck plank 23 may be further retained to members 3 by bolts 18 and nuts 19.

Figure 3:
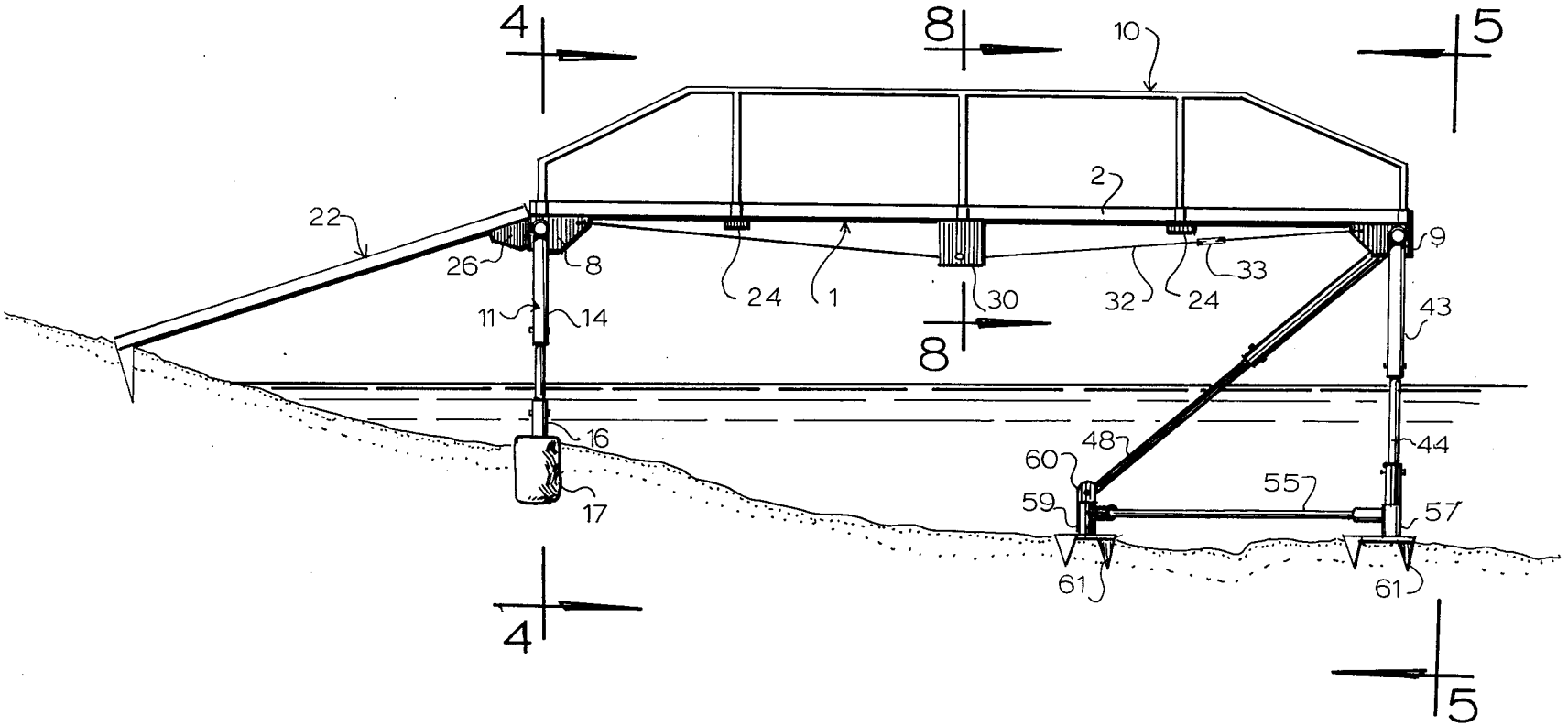
FIG. 3 is a side elevation view of the preferred embodiment shown in FIG. 1.

As shown in FIG. 3, pre-tensioned cables 32 are attached to the ends of and extend across the length of deck structure 2. From their points of attachment, cables 32 are arranged so that they extend in a direction obliquely downward to a point on brackets 30 having a spaced relationship to the underside of deck structure 2. It will be apparent from the construction of the present invention the pre-tensioning cables 32 which act obliquely at the ends of deck structure 2 results in bending pre-stresses in the longitudinal members 3 and that these stresses oppose the bending stresses from normal loads acting on top of deck structure 2. It will be further apparent that this is an efficient type of construction and that the weight of mainspan 1 of the present invention may be less than existing construction wherein the mainspans are not pre-stressed.

Pre-tensioned cables 32 are comprised of standard wire 34 commonly known in the trade as wire rope, a means 33 for pre-tensioning said wire rope 34 and means 35 for attaching cables 32 to deck structure 2. Although I have shown a socket type end fitting 35 as a means for attaching cables 32, a variety of other means are available. A turnbuckle 33 connected to wire 34 or any other suitable means may be used for pre-tensioning cables 32. In FIG. 8 is shown a means for maintaining a spaced relationship of each of said cables 32 to deck structure 2 comprising a tubular cable guide 31 and washer 36 pivotally connected by bolt 18 and nut 19 to bracket 30.

Figure 2:
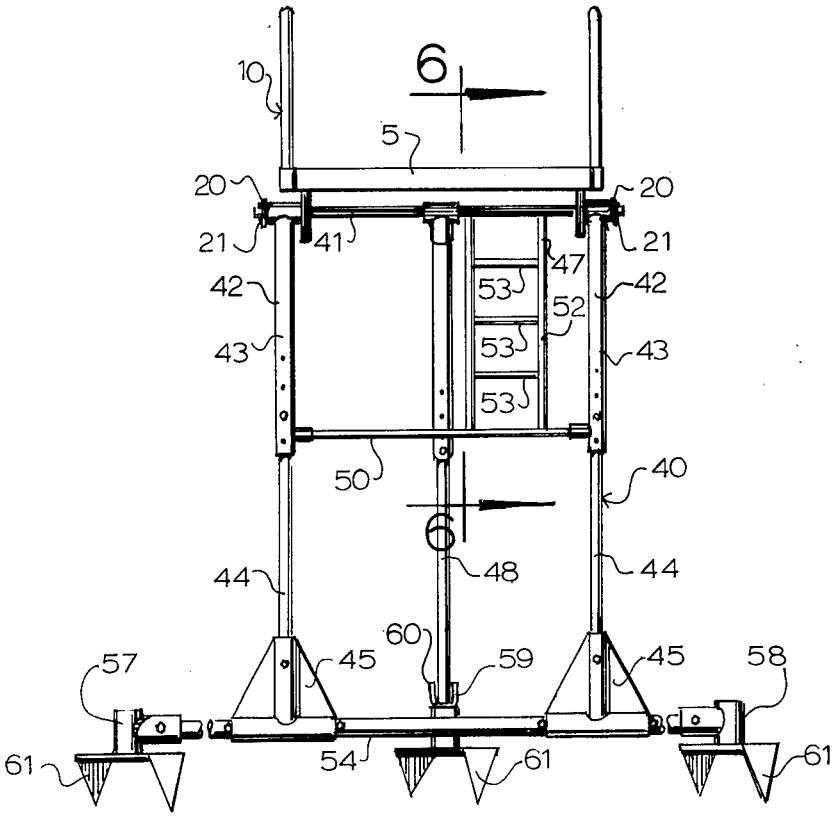
FIG. 2 is a rear elevation view of the preferred embodiment shown in FIG. 1.

With reference to FIGS. 1 and 2, the tripod structure 40 is shown comprising an open triangular base structure 46 of tubular members 54, 55 and 56 interconnected at their respective ends by couplings 57, 58 and 59, a bearing plate 61 at each corner of said base structure 46 affixed to said couplings, an inclined tubular member 48 pivotally connected at its lower end to a yoke portion 60 of coupling 59 and pivotally journaled at its upper end to lateral member 41, a pair of vertical tubular members 42 connected at their lower ends to base member 54 and connected at their upper ends to a lateral member 41 and an intermediate lateral member 50, said members 41 and 50 interconnecting said members 42.

In FIG. 5 is shown the construction of a pair of telescoping tubular members 42 wherein each of said members 42 comprises a first tubular upper portion 43, said first portion 43 being connected at its upper end to said lateral member 41, a second tubular center portion 44 and a third tubular lower portion 45, said third portion 45 being connected at its lower end to tubular base member 54. Opposing holes in the upper portion 43 and center portion 44 of member 42 are provided whereby corresponding holes may be aligned at a desired mainspan height and a bolt 18 and nut 19 installed through said holes for maintaining this height. Washer 20 and cotterpin 21 retain member 43 to lateral member 41. Also shown in FIG. 5 is a demountable ladder 47 attached at its upper end to member 41 and at its lower end to member 50, said ladder 47 comprising a pair of vertical members 52 and interconnecting horizontal members 53.

In FIGS. 2 and 3 the construction of the telescoping inclined tubular members 48 is shown as being similar in construction to members 42 except for the lower end of member 48 being pivotally attached to a yoke portion 60 of coupling 59 and the upper end pivotally attached to member 41.

The construction of the vertical support structure 11 is shown in FIG. 4 wherein a pair of telescoping vertical support members 14 are similar in construction to tripod members 43 and 44. The upper ends of members 14 are connected to a lateral member 15 while the lower end of members 11 are connected to a lateral base member 25, said base member 25 being connected to couplings 16 and said couplings 16 being retained by a pair of cement footings 17.

Since the angle of inclination of member 48 is dependent upon mainspan 1 height, it is necessary to provide pivot attachments at the upper and lower ends of inclined member 48. It is apparent from the drawings that the remaining vertical members of the mainspan 1 support structures may be either rigidly or pivotally attached to their base structures. Journal connections at the lower attachment of vertical members 14 and 42 to lateral base members 15 and 54 provide the option, after removal of ramp 22 and mainspan 1, of rotating the mainspan support structures about their lower attachments for underwater storage.

With reference to FIG. 6, the means for pivotally attaching ramp 22 to mainspan 1 and attaching said mainspan 1 to tripod support structure 40 and vertical support structure 11 are shown whereby downward opening notches are provided in a pair of downward extending brackets 26 affixed to the corners or ramp 22, and said downward extending brackets 8 in mainspan 1 and notches engage lateral member 15 of mainspan 1. Optionally, holes in said brackets 8 and 26 may be used in place of notches.

Downward extending dart configured anchors in bearing plates 61 and ramp 22 anchor the triangular base structure 46 and prevent a lateral displacement of the dock assembly.

Figure 7:
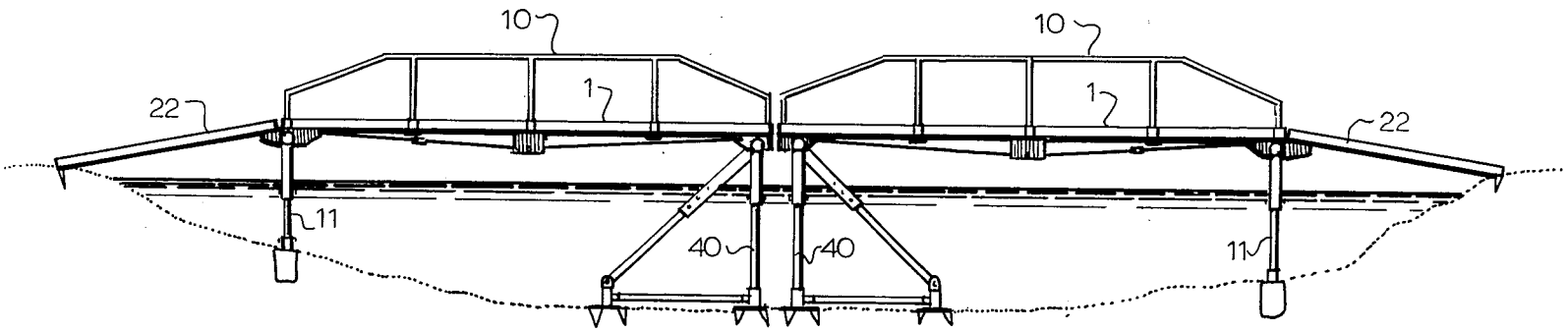
FIG. 7 is a side elevation view of a bridge construction according to the present invention.

In FIG. 7 is shown an alternate embodiment of the present invention wherein a pair of dock assemblies are interconnected to provide a bridge assembly.

While two specific embodiments of the present invention have been shown, it will be appreciated that other embodiments drawing from individual features of the shown embodiment can be provided. For example, the construction of composite beam mainspan 1 can be used for ramp 22 wherein pre-tensioned cables 32 are connected to the ends of ramp 22 in the same manner as described herein for mainspan 1. Also, my tripod structure 40 may be used for supporting both ends of mainspan 1.

Having now described my invention and the manner of making and using its, one can see that what has been achieved is a dock assembly which is of reasonable cost, attractive, adjustable for variations in water level and readily assembled and disassembled.

What I claim is new is:

1. A lightweight demountable dock assembly having a pre-stressed mainspan deck structure comprising:

a mainspan deck structure;

pre-tensioned cables extending across the length of said deck structure, the ends thereof attached to corresponding ends of said structure, said cables being directed from their points of attachment obliquely downward to a point between said attachments having a spaced relationship to the underside of said deck structure whereby a lightweight mainspan deck structure may be provided as a result of said pre-tensioning of said cables producing bending pre-stresses in said structure in opposition to the bending stresses from normal loads acting on top of said structure;

means for attaching said cable ends to corresponding ends of said deck structure;

means for pre-tensioning said cables;

means for directing said cables from their points of attachment obliquely downward to a point between said attachments having a spaced relationship to the underside of said deck structure;

a ramp structure pivotally connected to one end of said deck structure; and means for supporting the ends of said deck structure.

2. A lightweight demountable dock assembly according to claim 1 wherein said deck and ramp structures comprise:

open ended frames, the outer members of each of said frames being a pair of spaced longitudinal members and a lateral end member adjoining one pair of corresponding ends of said longitudinal members, said members being constructed from channel configured materials disposed such that the flange portions thereof extend horizontally inward from outer vertical portions thereof;

a plurality of lateral braces atached to the underside surfaces of said longitudinal members;

a plurality of transversely oriented deck planks within said frame, the end portions thereof retained by the channel configuration of said outer members whereby said deck planks may be assembled to said deck structure by inserting said planks through the open end of said frame; and means for securing one of said deck planks nearest the open end of said frame to the longitudinal outer members of said frame.

3. A lightweight demountable dock assembly according to claim 1 wherein said means for supporting the ends of said deck structure comprise:

at one end of said deck structure a tripod support comprising a triangular base structure having three outer members interconnected at the ends thereof in the form of an open frame said frame symmetrically disposed under said deck structure such that one of said base members in transverse relationship to said deck structure is substantially greater in length than the width of said deck structure and the other two base members being of approximately the same length as said transverse member have their point of interconnection directly below said deck structure, means for anchoring said base structure, a pair of vertical members connected at the upper ends thereof to the outer corners of said deck structure and at the lowere ends thereof to said transverse member of the base structure and an inclined member connected at the upper end thereof to the end of said deck structure at a point about midway between said vertical members and at the lower end thereof to the corner of said base structure directly below said deck structure whereby said tripod support is able to resist both vertical and lateral loads acting on said deck structure and is lightweight in construction; and at the other end of said deck structure a pair of vertical support members connected at the upper ends thereof to the outer corners of said deck structure and a means for anchoring the lower ends thereof.

4. A lightweight demountable dock assembly according to claim 3 wherein said means for anchoring the base of the tripod structure comprises a bearing plate under and affixed to each corner of said base structure, said bearing plates having downward extending dart configured anchors.

5. A lightweight demountable dock assembly according to claim 3 wherein at the end of said deck structure opposite said end supported by said tripod support said means for anchoring the lower ends of said pair of vertical supports comprises a cement footing at each of said ends.

6. A lighweight demountable dock assembly according to claim 3 wherein the lower end portions of said vertical and inclined members at the ends of said deck structure are pivotally connected comprising:

at the end of said deck structure supported by said tripod support a coupling having a yoke portion to which the lower end portion of the inclined member of said tripod support is pivotally connected, said coupling being affixed to said triangular base structure at the corner thereof directly under said deck structure and at each of the lower end portions of the vertical members of said tripod support a coupling affixed to said end portion and journaled about the transverse member of said triangular base structure whereby said vertical members are pivotable about the lower end portions thereof; and at the other end of said deck structure a transverse member directly below said end, means for anchoring the end portions of said transverse member a coupling affixed to the lower end portion of each of the vertical members supporting the end of said deck structure said coupling being journaled about said transverse member whereby said vertical members are pivotable about the lower end portions thereof such that said members may be rotated and stored under water with said vertical and inclined members of said tripod support after said ramp and deck structure have first been detached from the upper end portions of said rotatable members.

7. A lightweight demoutable dock assembly according to claim 1 wherein said means for pre-tensioning each of said cables is a turnbuckle affixed to and in-line with said cable.

8. A lightweight demountable dock assembly according to claim 1 wherein said means for directing each of said cables from their points of attachment obliquely downward to a point having a spaced relationship to the underside of said deck structure comprises:

a bracket affixed to and extending downward from the underside of said deck structure, said bracket being positioned at about the mid point of said deck structure;

a tubular cable guide laterally disposed to said bracket;

fastening means for affixing said guide to said bracket; and a washer at the outer end of said bracket opposite said bracket and retained to said guide by said means fastening said guide to said bracket whereby said cable bears upon the underside of said guide and is laterally by said washer.

9. A lightweight demountable dock assembly according to claim 1 wherein said deck and ramp structures may be quickly and easily detached from the means supporting the ends of said deck structure comprising:

a lateral member at each end of said deck structure said member being affixed to the upper portions of said means supporting the end thereof;

a bracket affixed to each of the outer corners of said deck structure and the outer corners of said ramp nearest said deck structure, said brackets extending downward from the corners and having downward opening notches engaging said lateral members whereby said deck and ramp structures may be quickly and easily detached from the means supporting the ends of said deck structure by disengaging the notches in said brackets from said lateral members.

10. A lightweight demountable dock assembly according to claim 1 wherein said means for supporting the ends of said deck structure provide for the adjustment of deck structure height and comprise:

upright telescoping tubular members pivotally connected at the upper ends thereof to the end portions of said deck structure, each of said members having an upper tubular portion in slideable engagement with a lower tubular portion, said portions having a plurality of transverse holes disposed such that matching pairs of holes in said upper and lower tubular portions may be aligned at a desired height of said deck structure;

a corresponding locking member for each of said telescoping tubular members, each of said locking members being installed through a matching pair of aligned holes in one of said telescoping members whereby the length of said member may be fixed for maintaining a desired height of said deck structure; and a base structure at each end of said deck structure, said base structures being disposed below said telescoping members and having the lower end portions of said telescoping members pivotally attached thereto.

11. A lightweight demountable dock assembly according to claim 1 wherein demountable guardrails are provided directly above in alignment with the sides of said mainspan deck structure, said guardrails having tubular lower end portions in slideable engagement with tubular sockets affixed to said deck structure whereby said slideable engagement of said guardrails in said tubular sockets provides a means of easy detachment of said guardrails from said deck structure and a system of friction dampers for de-coupling said deck structure from oscillatory loads acting thereon.

12. A lightweight demountable dock assembly according to claim 1 wherein a ladder is provided at one end of said dock assembly attached at the upper end thereof to to end portion of said deck structure and at the lower end thereof to the means for supporting the end of said deck structure.

13. A lightweight demountable dock assembly having interconnected mainspan deck structures wherein each of said deck structures is pre-stressed by a pre-tensioned cable comprising:

a plurality of deck structures, said structures being interconnected;

pre-tensioned cables extending across the length of each of said deck structures, the ends thereof attached to corresponding ends of said deck structures, said cables being directed from their points of attachments obliquely downward to a point between said attachments having a spaced relationship to the underside of a corresponding deck structure whereby lightweight deck structures may be provided as a result of said pre-tensioning of said cables producing bending pre-stresses in said deck structures in opposition to the bending stresses from normal loads acting on top of said deck structures;

means for attaching the ends of said cables to corresponding ends of said deck structures;

means for pre-tensioning said cables;

means for directing said cables from their points of attachment obliquely downward to a point between said attachments having a spaced relationship to the underside of a corresponding deck structure;

a ramp structure pivotally connected at one end of said dock assembly to one of said deck structures; and means for supporting the ends of each of said deck structures.

14. A lightweight demountable dock assembly comprising:

a mainspan comprising a deck structure having an open ended outer frame constructed of channel members with the flange portions of said channel members disposed horizontally and extending interiorally in said frame, a plurality of deck planks laterally disposed interiorally in said frame with the ends thereof retained within the channel configuration of said outer members, a plurality of lateral braces attached to the underside of said frame, means for securing the deck plank nearest the open end of said frame to said frame, pre-tensioned cables extending across the length of said frame with the ends thereof attached to the ends of said frame and directed from said attachments, obliquely downward to a point between the attachments having a spaced relationship to the underside of said frame, means for attaching said cables, means for pretensioning said cables, means for directing said cables from their points of attachment obliquely downward to a point between said attachments having a spaced relationship to the underside of said frame and demountable guardrails directly above and aligned with the sides of said frame, the lower end portions of said guardrails being slideable engaged with tubular members affixed to the outer member of said frame;

a tripod support at one end of said mainspan comprised of a pair of vertical telescoping tubular members pivotally connected at the upper end portions thereof to one end portion of said mainspan, an inclined telescoping tubular member pivotally connected at the upper end portion thereof to the same end portion of said mainspan, a triangular base structure disposed directly below the lower end portions of said vertical and inclined telescoping members, said lower end portions being pivotally connected to said base structure, means for fixing said telscoping members at a length corresponding to a desired mainspan height and means for anchoring said triangular base structure;

a pair of vertical telescoping tubular members pivotally connected at the upper end portions thereof to the other end portion of said mainspan, means for fixing said telescoping members at a length corresponding to a desired mainspan height and means for anchoring the lower end portions of said telescoping members;

a ramp pivotally connected to one end of said mainspan; and means for anchoring the other end of said ramp.

* * * * *